US006679974B1

(12) United States Patent
Soini

(10) Patent No.: US 6,679,974 B1
(45) Date of Patent: Jan. 20, 2004

(54) PROCEDURE AND MEANS FOR GENERATING TURBULENCE IN STOCK SUSPENSION FLOW

(75) Inventor: Sakari Soini, Somero (FI)

(73) Assignee: Metso Paper, Inc., Helsinki (FI)

( * ) Notice: Subject to any disclaimer, the term of this patent is extended or adjusted under 35 U.S.C. 154(b) by 8 days.

(21) Appl. No.: 10/089,800

(22) PCT Filed: Oct. 2, 2000

(86) PCT No.: PCT/FI00/00843

§ 371 (c)(1),
(2), (4) Date: Jun. 24, 2002

(87) PCT Pub. No.: WO01/25532

PCT Pub. Date: Apr. 12, 2001

(30) Foreign Application Priority Data

Oct. 4, 1999 (FI) ..... 19992133

(51) Int. Cl.[7] ..... D21F 1/02

(52) U.S. Cl. ..... 162/336; 162/343; 162/212; 162/216

(58) Field of Search ..... 162/216, 336, 162/343, 344, 202, 212, 337–341

(56) References Cited

U.S. PATENT DOCUMENTS

| | | | | | |
|---|---|---|---|---|---|
| 3,725,197 | A | * | 4/1973 | Dahl et al. | 162/343 |
| 3,843,470 | A | * | 10/1974 | Betley et al. | 162/343 |
| 3,923,593 | A | * | 12/1975 | Verseput | 162/301 |
| 4,125,429 | A | | 11/1978 | Hergert et al. | |
| 4,133,713 | A | | 1/1979 | Chuang | |
| 4,137,124 | A | * | 1/1979 | Bubik et al. | 162/343 |
| 4,543,162 | A | | 9/1985 | Hildebrand | |
| 4,617,091 | A | * | 10/1986 | Rodal et al. | 162/343 |
| 5,074,965 | A | | 12/1991 | Keskiivari et al. | |
| 5,124,002 | A | | 6/1992 | Kade | |
| 5,133,836 | A | * | 7/1992 | Allen | 162/343 |
| 5,183,537 | A | | 2/1993 | Hergert et al. | |
| 5,431,785 | A | * | 7/1995 | Bubik et al. | 162/343 |
| 5,603,807 | A | * | 2/1997 | Heinzmann | 162/343 |

FOREIGN PATENT DOCUMENTS

| | | |
|---|---|---|
| FI | 84921 | 10/1991 |
| FI | 88317 | 1/1993 |
| WO | WO 01/25532 A1 | 4/2001 |

* cited by examiner

*Primary Examiner*—Peter Chin
*Assistant Examiner*—Eric Hug
(74) *Attorney, Agent, or Firm*—Stiennon & Stiennon

(57) ABSTRACT

In a paper machine headbox, a stock suspension flow passes through turbulence pipes ($14a_n$) and is distributed into superimposed layers. Stepped expansion spots (16) of the flow cross-section area of the turbulence pipes (14) or the positions of trailing elements starting from between the pipe rows ($R_n$) and extending to the slice duct (12) of the headbox control the onset and level of turbulence in each layer. Turbulence is generated in different phases of the flow in different layers by arranging the expansion spots (16) and/or the trailing elements in superimposed layers to be located at different distances from the slice opening (13) of the headbox, whereby a different turbulence prevails at the slice opening (13) in different layers of the stock suspension flow.

16 Claims, 3 Drawing Sheets

PROCEDURE AND MEANS FOR GENERATING TURBULENCE IN STOCK SUSPENSION FLOW

CROSS-REFERENCES TO RELATED APPLICATIONS

This application is a U.S. national stage application of International Application No. PCT/FI00/00843, filed Oct. 2, 2000, and claims priority on Finnish Application No. 19992133 filed Oct. 4, 1999, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a procedure for generating and maintaining turbulence in stock suspension flow conducted through a turbulence generator into the slice duct of the headbox and therefrom through the slice opening to the web former, in which procedure the stock suspension flow is with the aid of turbulence pipes divided into a number of superimposed layers, whereafter the effect of the elements creating and maintaining turbulence is directed thereupon.

The invention also relates to a turbulence generator of the headbox of a paper machine, comprising a number of overlapping turbulence pipes being arranged in rows and extending across the entire width of the headbox, through which pipes the stock suspension flow to be conducted from the headbox to the web former is arranged to flow and which turbulence pipes are provided with stepwise expansion of the flow cross-section area between the inlet and outlet of the pipe, and to which turbulence generator a plurality of headbox dividers or lamellae can moreover be connected, starting from between the pipe rows and extending to the slice duct of the headbox.

It is of vital importance, considering the quality of the paper/board being manufactured, to understand what kind of turbulence spectrum of stock suspension flow prevails in the slice duct of the headbox and in the subsequent web former. The turbulence generated with the aid of the turbulence generator in the stock suspension flow will decrease quite rapidly unless turbulence energy is continuously added in the flow. The formation of paper or board is best enhanced by small-scale vortices which efficiently disintergate fibre bundles. Large-scale vortices may even be detrimental considering the formation of paper. Owing to the properties of the turbulence, the small-scale vortices are first to reduce in the flow, whereby, for instance, the surface layer of the web on the Fourdrinier wire and the middle layer of the web on a gap former tend to be more flocculated than the other layers due to decreasing turbulence. A generally employed manner to increase turbulence energy in the flow by using the draw between the slice jet and the wire does not act in the area being dewatered last. In order to have more turbulence in said area, the draw is to be great. Hereby, the formation of the area dewatered first is easily deteriorated to the extent that the formation of the entire product can no longer be improved. A similar progress may also occur when endeavours are made in the web former to introduce turbulence energy into a stock suspension layer not yet dewatered, e.g. by means of loading lists through a layer already dewatered.

In a majority of the state-of-art turbulence generators, all turbulence pipes are mutually identical because the aim is to achieve homogeneous turbulence in different parts of the stock flow. Such turbulence generators make no difference between the bottom, surface and middle layers of the web. In web formation, said layers become, however, dewatered at different times. On the Fourdrinier wire, the surface layer is dewatered last and in the gap former the layer to be dewatered last is the middle layer.

In patent specification U.S. Pat. No. 5,124,002, a turbulence generator is disclosed in which the flow cross-section areas of the turbulence pipes in superimposed layers differ in size and shape, and advantageously, the mutual spaces between the pipes are also different. In this manner, a different microturbulence level can be generated in different layers of the stock suspension flow discharging from the turbulence generator into the slice duct, and such paper can be manufactured which is provided with different fibre orientations in superimposed layers. The flow cross-section area of each turbulence pipe remains the same from the first part of the pipe to the end thereof.

Such turbulence generators are also known in the art in which the flow cross-section area of the turbulence pipes is step-wise expanded at least at one spot between the inlet and the outlet of the pipe. In the turbulence generators known in the art, the expansion spots of the pipe are at equal distance from the outlet of the pipe in all pipes. One such prior art design is disclosed in U.S. Pat. No. 5,183,537.

SUMMARY OF THE INVENTION

The objective of the present invention is to develop a new procedure for generating and maintaining turbulence and a new kind of turbulence generator, with the aid of which a different turbulence can be generated in different layers of stock suspension flow flowing out of the headbox.

One more aim of the invention is to achieve an application in which the turbulence of the stock suspension layer dewatered last in the former after the headbox can be maintained closer to the optimal level during the formation than with currently used turbulence generators. Thus, the aim is a stock suspension flow in which the turbulence is "freshest", and consequently, most lasting in the layers of the flow which stay "running" longest. When the impact of the factors generating turbulence in the flow ceases, the turbulence begins to slow down rapidly. The turbulence is the fresher the shorter length the flow has propagated after the generation of turbulence.

To achieve said objectives and those to be disclosed below, the procedure of the invention is characterized in that turbulence is generated in different layers of the flow in different phases of the flow by arranging the elements generating and maintaining turbulence at different distances from the slice opening of the headbox, so that a different turbulence prevails in different layers of the stock suspension flow.

Respectively, the turbulence generator of the invention is characterized in that the distance of the expansion spot of the turbulence pipes in superimposed pipe rows from the slice opening of the headbox and/or the distance of the tips of the trailing elements in association with the pipe rows from the slice opening of the headbox is different so that at the slice opening, the turbulence is different in different layers of the stock suspension flow.

In an advantageous embodiment of the invention, the expansion spots of individual turbulence pipes of a turbulence generator are so stepped that in the superimposed turbulence pipe rows, the expansion of the flow cross-section area is carried out at a different distance from the slice opening of the headbox. The later the phase is in which the cross-section area of a turbulence pipe expands, the fresher is the turbulence as the stock suspension flow discharges from the slice opening of the headbox onto the forming wire or into the gap between the forming wires. The expansion spots of the turbulence pipes acting on the layer of the stock suspension flow to be dewatered last are arranged to be last in the flow direction, that is, closest to the slice opening.

In addition to stepping the expansion spots, or instead of it, a different turbulence can be generated in different layers of the stock suspension flow by providing, after the turbulence pipes, trailing elements extending to the slice duct, which in superimposed flow layers extend to a different distance from the slice opening of the headbox. The trailing elements can be fixed in length or their lengths can be adjustable, as in U.S. Pat. No. 4,133,713. Alternatively, the fixing point of a trailing element in the longitudinal direction to the headbox can be adjustable, as in FI patent specification No. 88317. The purpose of the trailing elements is to keep different layers of the stock suspension flow separated as long as possible after a different turbulence has first been generated in the layers, for example, by stepping the expansion parts or by employing turbulence pipes differing in the flow cross-section area. The trailing elements maintain and strengthen the difference of turbulences prevailing between different layers. Alternatively, all trailing elements can be mutually of equal length, whereby various levels of turbulence prevailing in different layers can be achieved solely with the aid of structural differences of turbulence pipes.

The invention is described below more in detail, reference being made to the figures of the accompanying drawing, to which, however, the invention is not intended to be exclusively restricted.

DESCRIPTION OF THE PREFERRED EMBODIMENTS

Figure 1:
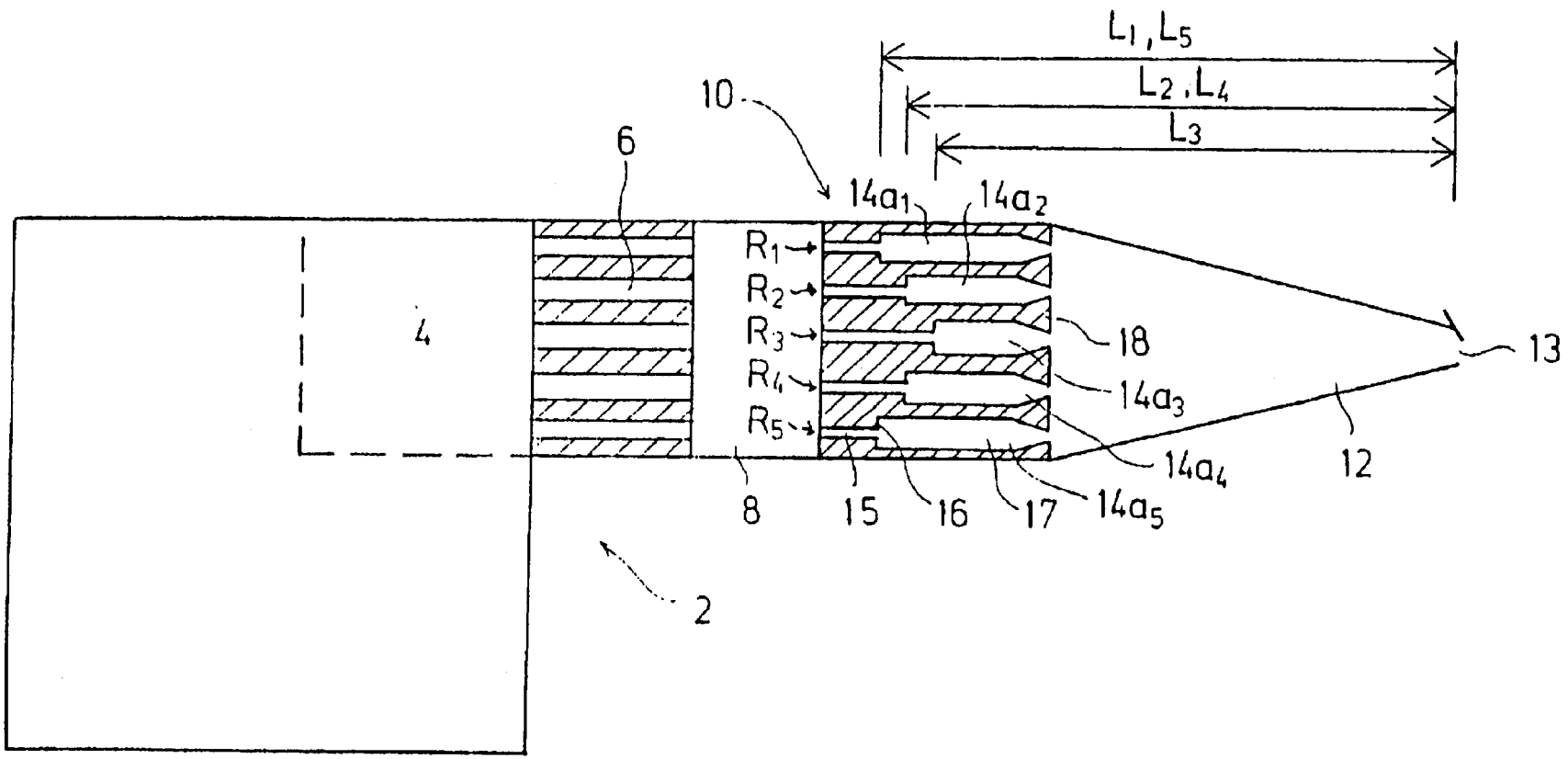
FIG. 1 presents schematically a headbox provided with a turbulence generator of the invention, being particularly appropriate for use in connection with a gap former.

FIG. 1 presents in cross-section a simplified headbox 2 for a paper machine. Stock suspension is brought to the headbox 2 via a cross-direction stock inlet header 4, wherefrom the flow is distributed into a number of distributor pipes 6 in machine direction. Subsequent to the distributor pipes 6, the stock suspension flows through an equalization chamber 8 into the flow pipes 14$a_1$ . . . 14$a_5$ of the turbulence generator 10, and further, into a wedgewise tapering slice duct 12, wherefrom the stock suspension spray is discharged through a slice opening 13 to the web former.

The turbulence pipes 14$a_1$ . . . 14$a_5$ of the turbulence generator 10 are arranged in five superimposed rows $R_1$ . . . $R_5$ extending in cross machine direction across the entire width of the headbox 2. Each individual turbulence pipe 14$a_1$ . . . 14$a_5$ comprises an initial section 15 relatively narrow in cross-section, expanding stepwise at point 16 into an end section 17 wider than the initial section 15. Preferably, the initial section 15 of the pipe is circular in cross-section and also the end section 17 starts circular at the expansion 16 but ends rectangular on the side of the slice cone 12, so that necks 18 are left between the superimposed turbulence pipes 14$a_1$ . . . 14$a_5$. As known in the art, the cross-section of the latter part can also be different, such as triangle, square or polygon. The expansions 16 of the flow cross-section area in the turbulence pipes 14$a_1$ . . . 14$a_5$ cause a change of the flow rate in the stock suspension flowing through the turbulence generator 10 and an increase in the amount of turbulence.

Thus, each row $R_n$ of turbulence pipes comprises a plurality of parallel turbulence pipes 14$a_n$, these being mutually identical in said horizontal row $R_n$. The subscript n refers to the order number 1 to 5 of the pipe, starting from the topmost pipe. The superimposed turbulence pipes 14$a_1$ . . . 14$a_5$ differ from one another in the respect that the expansion spot 16 of the flow duct 14$a_n$ is in different pipe rows $R_1$ . . . $R_5$ placed at a different distance $L_n$ from the slice opening 13 of the headbox. Said distance $L_n$ reduces in the order $L_1=L_5>L_2=L_4>L_3$.

The headbox as in FIG. 1 is intended for use in association with the gap former. When a web is dewatered between two wires, the middle layer thereof is dewatered last. In order to maintain a sufficient micro-turbulence level considering the achieving of uniform formation as long as possible also in the middle layer of the stock flow being dewatered last, the expansion points 16 in the centermost row of pipes $R_3$ are positioned closest to the outlet end of the turbulence generator 10 and the slice opening 13 of the headbox, respectively, in the topmost $R_1$ and the lowermost $R_5$ pipe row, the expansion points 16 are farthermost from the outlet end of the turbulence generator 10.

Figure 2:
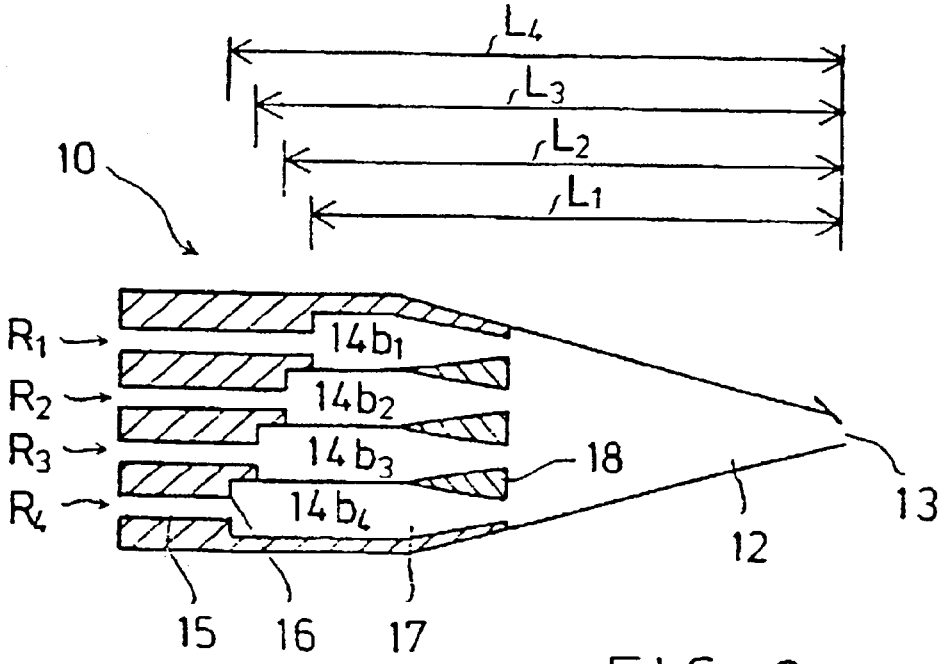
FIG. 2 presents a turbulence generator which is particularly appropriate for use in connection with a Fourdrinier or hybrid former.

FIG. 2 presents a turbulence generator 10 which is particularly appropriate for use in association with the web forming units starting with a Fourdrinier wire portion. The means comprises four superimposed rows $R_1$ . . . $R_4$ of turbulence pipes 14$b_1$ . . . 14$b_4$. The expansion spots 16 of the turbulence pipes are in this instance stepped to grow in that the space $L_4$ between the expansion 16 and the slice opening 13 in the turbulence pipes 14$b_4$ of the lowermost pipe row $R_4$ is greatest and in the topmost pipe row $R_1$, the respective distance $L_1$ is smallest. The lowest layer of the stock suspension flow sprayed onto the Fourdrinier wire is filtered first and the topmost layer, last. To have the turbulence maintained longer in the upper stock suspension layer being dewatered last, the locations of the expansion 16 of the flow cross-section area are in the present embodiment stepped so that the expansions 16 in the lowermost pipe row $R_4$ closest to the level of the Fourdrinier wire are earlier in the flow direction and the pipe expansions 16 in the topmost pipe row $R_1$ farthermost from the Fourdrinier wire are last in the flow direction.

Figure 3:
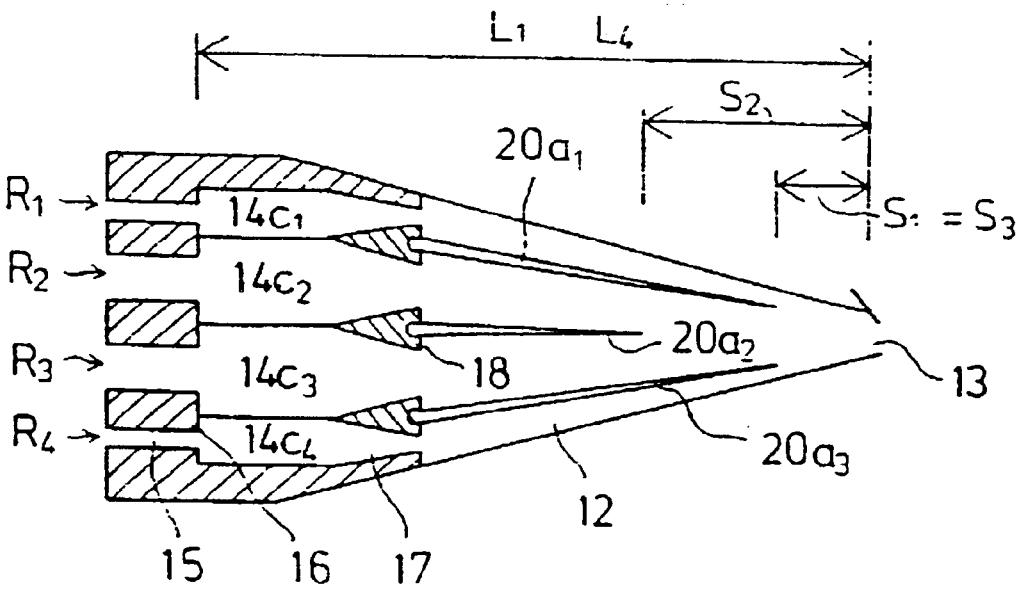
FIG. 3 presents a turbulence generator according to a second embodiment of the invention particularly for a gap former.

FIG. 3 shows a turbulence generator for a gap former according to another embodiment of the invention. In this instance, the stepped expansion 16 located between the narrow initial part 15 of the turbulence pipe 14$c_1$ . . . 14$c_4$ and the wide latter part 17 thereof is in all four superimposed rows $R_1$ . . . $R_4$ of turbulence pipes in the flow direction at one and same distance from the slice opening 13 of the headbox. Instead, the superimposed turbulence pipes 14$c_1$ . . . 14$c_4$ have different cross-sections so that the cross-section areas of the topmost and the lowermost turbulence pipes 14$c_1$ and 14$c_3$ are smaller than the cross-section areas of the two centermost turbulence pipes 14$c_2$ and 14$c_3$. The greater the cross-section of the flow duct, the greater in dimension is the turbulence generated in the pipe. A turbulence of a greater dimension also slows down more slowly than a turbulence of a smaller dimension.

A turbulence generator as in FIG. 3 comprises further three trailing elements 20$a_1$ . . . 20$a_3$ fastened as extensions to necks 18 separating the three superimposed pipe rows $R_1$ . . . $R_4$ from each other, said elements extending to the slice cone 12 of the headbox. The purpose of the trailing elements 20$a_1$ . . . 20$a_3$ is to keep the stock suspension flows of turbulence of different magnitude, coming from turbulence pipes 14$c_1$ . . . 14$c_4$, apart from each other and in addition, to generate and/or to maintain the turbulence of the flow. In the design of the invention, said three trailing elements 20$a_1$ . . . 20$a_3$ are different in length so that the topmost and the lowermost trailing elements 20$a_1$ and 20$a_3$ extend to the same distance $s_1$=$s_3$ from the slice opening 13 of the headbox, and the middlemost trailing element 20$a_2$ is shorter than the others, extending to distance $s_2$.

Figure 4:
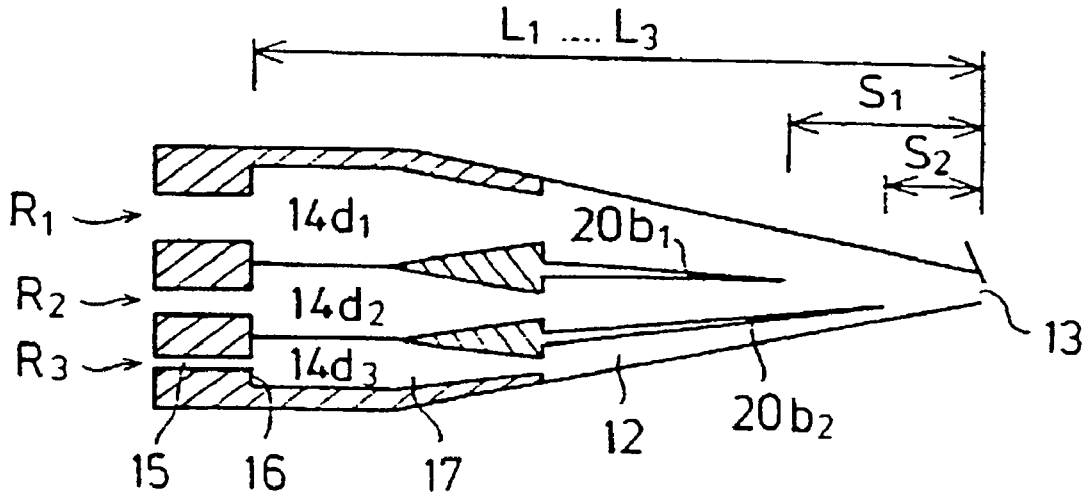
FIG. 4 presents a turbulence generator appropriate for Fourdrinier and hybrid formers.

The turbulence generator in FIG. 4 is intended for a Fourdrinier or hybrid former. As in FIG. 3, also in the present embodiment the cross-section areas of the turbulence pipes 14$d_1$ . . . 14$d_3$ arranged in three superimposed rows $R_1$ . . . $R_3$ are different so that the cross-section area in the lowermost pipe row 14$d_3$ is smallest and the cross-section area in the topmost pipe row 14$d_1$, and hence, also the dimension of the turbulence generated in the flow, is greatest. The lengths of two trailing elements 20$b_1$ and 20$b_2$ fastened as continuations to pipe rows $R_1$ . . . $R_3$ are arranged so that the distance $S_2$ of the tip of the trailing element 20$b_2$ from the slice opening 13 separating the two lowermost stock flows from each other is greater than the respective distance $s_1$ of the trailing element 20$b_1$ separating the two topmost stock flows from each other.

Figure 5:
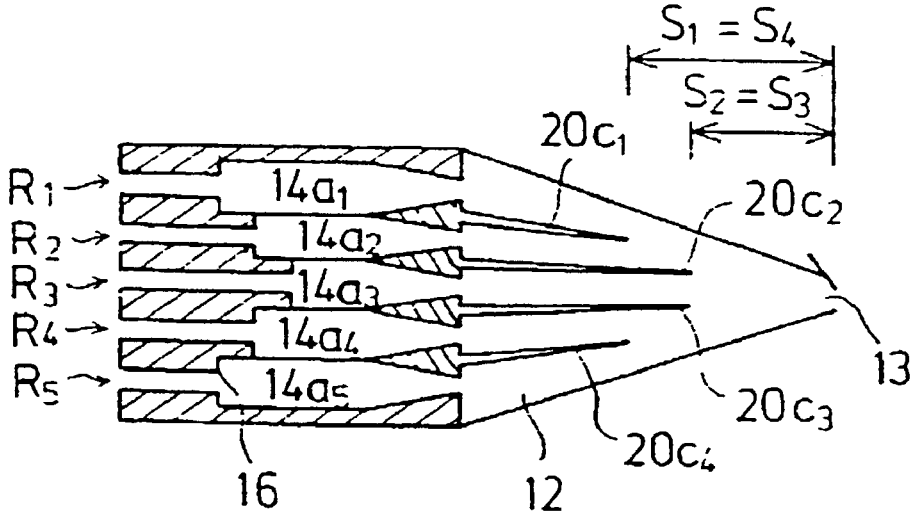
FIG. 5 presents a turbulence generator appropriate for a gap former, in which two advantageous embodiments of the invention are combined.

FIG. 5 presents a turbulence generator appropriate for a gap former, in which the technology of FIG. 1 and FIG. 3 is combined in an advantageous fashion. The expansion spots 16 in superimposed rows $R_1$ . . . $R_5$ of turbulence pipes 14$a_1$ . . . 14$a_5$ are so stepped that the centermost turbulence pipe 14$a_3$ expands last in the flow direction and the two sidemost turbulence pipes 14$a_1$ and 14$a_5$ expand first in the flow direction. As extensions to the partitions 18 of the turbulence pipes 14$a_1$ . . . 14$a_5$ four trailing elements 20$c_1$ . . . 20$c_4$ are arranged, of which the distance $s_2$=$s_3$ of the tips of two centermost trailing elements 20$c_2$ and 20$c_3$ is smaller than the respective distance $s_1$=$s_4$ of the two trailing elements 20$c_1$ and 20$c_4$ closer to the edge.

Also several other modifications of the invention are conceivable within the scope of the claims presented below. For instance, the trailing elements separating superimposed flows from each other can be mutually of identical dimensions when a layered turbulence has been generated in the stock suspension flow already in the preceding turbulence pipes.

I claim:

1. A turbulence generator in a headbox of a paper machine, the headbox having a width, and a slice opening, the turbulence generator comprising:

a plurality of superimposed turbulence pipes arranged in rows extending across the entire width of the headbox, through which a stock suspension flow to be conducted from the headbox through the slice opening to a web former is arranged to flow; and portions of each turbulence pipe which define a stepped expansion of the flow cross-section area in the space between an inlet end and an outlet end of each pipe, the stepped expansion of each turbulence pipe being positioned at an expansion spot, wherein in superimposed pipe rows, the distance of the expansion spot of the turbulence pipes from the slice opening of the headbox in association with the pipe rows, is different in that at the slice opening, in the headbox a different turbulence prevails in different layers of the stock suspension flow; and wherein the superimposed rows of turbulence pipes include a centermost row of pipes, and wherein the expansion spots of the pipes within a row are positioned closer to the slice opening of the headbox, the closer said pipe row is to the centermost pipe row.

2. The turbulence generator of claim 1, further comprising:

a plurality of trailing elements connected to the turbulence generator, starting from between the pipe rows and extending towards the slice duct of the headbox, each trailing element having a tip at its downstream end; and wherein in superimposed pipe rows, the distance of the tips of the trailing elements from the slice opening of the headbox in association with the pipe rows, is different in that at the slice opening a different turbulence prevails in different layers of the stock suspension flow.

3. A turbulence generator in a headbox of a paper machine, the headbox having a width, and a slice opening, the turbulence generator comprising:

a plurality of superimposed turbulence pipes arranged in rows extending across the entire width of the headbox, through which a stock suspension flow to be conducted from the headbox through the slice opening to a web former is arranged to flow; and portions of each turbulence pipe which define a stepped expansion of the flow cross-section area in the space between an inlet end and an outlet end of each pipe, the stepped expansion of each turbulence pipe being positioned at an expansion spot, wherein in superimposed pipe rows, the distance of the expansion spot of the turbulence pipes from the slice opening of the headbox in association with the pipe rows, is different in that at the slice opening, in the headbox, a different turbulence prevails in different layers of the stock suspension flow; and wherein the superimposed rows of turbulence pipes include a lowermost row of pipes, and wherein the expansion spots in a row are closer to the slice opening of the headbox, the farther said pipe row is from the lowermost pipe row of the turbulence generator.

4. A paper machine headbox apparatus having a width comprising:

a first row of a plurality of turbulence pipes extending across the entire width of the headbox;

a second row of turbulence pipes extending across the entire width of the headbox, and positioned below the first row;

a third row of turbulence pipes extending across the entire width of the headbox, and below the second row, wherein each turbulence pipe is comprised of an initial section of a first cross-sectional area, and an end section downstream of the initial section, the initial section being connected to the end section at a stepwise expansion point, at which the cross-sectional area increases, and a slice duct positioned to receive stock suspension flow from the turbulence pipes and discharging through a slice opening to a web former, wherein the stock suspension flow is distributed into a plurality of layers by the rows of turbulence pipes, turbulence being generated in different layers of the flow in different phases of the flow by the stepwise expansion points, the spacing of the stepwise expansion points from the slice opening being different depending on the row in which a particular turbulence pipe is located, and the headbox is structured and arranged so that at the slice opening a different turbulence prevails in different layers of the stock suspension flow; and wherein the second row of turbulence pipes is the centermost row, and wherein the expansion spots of the turbulence pipes within a row are positioned closer to the slice opening of the headbox, the closer said pipe row is to the centermost pipe row.

5. The paper machine headbox apparatus of claim 4 further comprising a plurality of trailing elements, each trailing element starting from between two turbulence pipe rows and extending towards the slice duct of the headbox, each trailing element having a tip at its downstream end; and the distance of the tips of the trailing elements from the slice opening of the headbox is not the same for all trailing elements.

6. A paper machine headbox apparatus having a width comprising:

a first row of a plurality of turbulence pipes extending across the entire width of the headbox;

a second row of turbulence pipes extending across the entire width of the headbox, and positioned below the first row;

a third row of turbulence pipes extending across the entire width of the headbox, and below the second row, wherein each turbulence pipe is comprised of an initial section of a first cross-sectional area, and an end section downstream of the initial section, the initial section being connected to the end section at a stepwise expansion point, at which the cross-sectional area increases;

a slice duct positioned to receive stock suspension flow from the turbulence pipes and discharging through a slice opening to a web former, wherein the stock suspension flow is distributed into a plurality of layers by the rows of turbulence pipes, turbulence being generated in different layers of the flow in different phases of the flow by the stepwise expansion points, the spacing of the stepwise expansion points from the slice opening being different depending on the row in which a particular turbulence pipe is located, and the headbox is structured and arranged so that at the slice opening a different turbulence prevails in different layers of the stock suspension flow; and wherein the third row of turbulence pipes is a lowermost row, and wherein the expansion spots in a row are closer to the slice opening of the headbox, the farther said pipe row is from the lowermost pipe row of the turbulence generator.

7. A paper machine headbox apparatus comprising:

a first row of turbulence pipes;

a second row of turbulence pipes below the first row;

a third row of turbulence pipes below the second row, wherein each turbulence pipe is comprised of an initial section of a first cross-sectional area, and an end section downstream of the initial section downstream of the initial section, the initial section being connected to the end section at a stepwise expansion point, at which the cross-sectional area increases;

a plurality of trailing elements, each trailing element starting from between two turbulence pipe rows and extending towards the slice duct of the headbox, each trailing element having a tip at its downstream end, and the distance of the tips of the trailing elements from the slice opening of the headbox is not the same for all trailing elements; and a slice duct positioned to receive stock suspension flow from the turbulence pipes and discharging through a slice opening to a web former, wherein the stock suspension flow is distributed into a plurality of layers by the rows of turbulence pipes, turbulence being generated in different layers of the flow in different phases of the flow by the stepwise expansion points and the trailing elements, and the headbox is structured and arranged so that at the slice opening a different turbulence prevails in different layers of the stock suspension; and wherein the second row of turbulence pipes is a centermost row, and wherein the cross-sectional areas after the stepwise expansion points of the turbulence pipes of the first row and the third row are less than the cross-sectional areas after the stepwise expansion points of the centermost row.

8. A paper machine headbox apparatus comprising:

a first row of turbulence pipes;

a second row of turbulence pipes below the first row;

a third row of turbulence pipes below the second row, wherein each turbulence pipe is comprised of an initial section of a first cross-sectional area, and an end section downstream of the initial section, the initial section being connected to the end section at a stepwise expansion point, at which the cross-sectional area increases;

a plurality of trailing elements, each trailing element starting from between two turbulence pipe rows and extending towards the slice duct of the headbox, each trailing element having a tip at its downstream end, and the distance of the tips of the trailing elements from the slice opening of the headbox is not the same for all trailing elements; and a slice duct positioned to receive stock suspension flow from the turbulence pipes and discharging through a slice opening to a web former, wherein the stock suspension flow is distributed into a plurality of layers by the rows of turbulence pipes, turbulence being generated in different layers of the flow in different phases of the flow by the stepwise expansion points and the trailing elements, and the headbox is structured and arranged so that at the slice opening a different turbulence prevails in different layers of the stock suspension; and wherein the third row of turbulence pipes is the lowermost row, and wherein the cross-sectional areas after the stepwise expansion points of the turbulence pipes of the second row are greater than the cross-sectional areas after the stepwise expansion points of the lowermost row, and the cross-sectional areas after the stepwise expansion points of the first row are greater than the cross-sectional areas after the stepwise expansion points of the second row.

9. A method for forming a paper web employing a headbox comprising the steps of:

generating and maintaining turbulence in a stock suspension flow which is conducted through a turbulence generator into a slice duct of the headbox and from the slice duct through a slice opening to a web former;

wherein the stock suspension flow is distributed into a number of superimposed layers of the varying turbulence generated with the aid of turbulence pipes, each pipe having an element for generating and maintaining turbulence, and all the layers flowing together within the headbox before the slice opening;

wherein the superimposed layers include at least one layer which is filtered first by the web former and at least one layer which is filtered last by the web former;

wherein the turbulence generated in the different layers of the flow are made different by arranging the elements generating and maintaining turbulence at different distances from the slice opening; and wherein the elements generating and maintaining turbulence are arranged so that those elements generating the layer(s) of the stock suspension being filtered last in the web former are positioned closer to the slice opening of the headbox, than the elements generating the layer(s) being filtered first.

10. The method of claim 9, wherein the elements generating and maintaining turbulence comprise stepped expansions of the flow cross-section area of the turbulence pipes, the stepped expansions being positioned in superimposed rows of the turbulence pipes at different distances from the slice opening of the headbox.

11. The method of claim 9, wherein the turbulence pipes have outlet ends through which the stock suspension flow passes into the slice duct, and wherein the elements generating and maintaining turbulence comprise trailing elements on the outlet ends of the turbulence pipes, the trailing elements extending to the slice duct of the headbox, wherein each trailing element has a tip, and wherein the distance of the tips from the slice opening of the headbox is arranged to be different between the superimposed flow layers.

12. The turbulence generator of the claim 9 wherein the flow cross-section areas of the turbulence pipes of one of the superimposed pipe rows are greater, the closer said pipe row is to a centermost pipe row of the turbulence generator.

13. The method of claim 9 wherein the web former is a gap former and wherein the superimposed layers include an uppermost layer and a lowermost which are filtered first.

14. The method of claim 9 wherein the web former is a Fourdrinier or hybrid former and wherein the superimposed layers include a lowermost layer which is filtered first and a plurality of upper layers which are filtered sequentially, and wherein the elements generating and maintaining turbulence in the upper layers are arranged progressively closer to the slice opening.

15. A paper machine headbox comprising:

a headbox having a width, and a slice opening;

a plurality of superimposed turbulence pipes, each pipe having an inlet and an outlet end, the superimposed turbulence pipes arranged in rows extending across the entire width of the headbox, which are arranged so that a stock suspension will flow through the turbulence pipes and into a slice and through the slice opening to a web former having at least one wire;

a plurality of trailing elements fastened as continuations to the pipe rows and extending into the slice and toward the slice opening, each trailing element having a downstream end defined by a tip;

portions of each turbulence pipe which define a stepped expansion of the flow cross-section area between the inlet and the outlet end of each pipe, the stepped expansion of each turbulence pipe defining an expansion spot;

wherein in the plurality of trailing elements, the length of the trailing elements from the pipe rows to the tip of the trailing element differ in length; and wherein the turbulence pipes of superimposed pipe rows have different an greater flow cross-section areas where the rows are more distant from the at least one wire.

16. The papermaking machine of claim 15 wherein the web former having two wires and the turbulence pipes of the superimposed pipe rows have greater flow cross-section areas where the rows are more distance from both wires.

* * * * *